US008951215B2

(12) United States Patent
Moretto

(10) Patent No.: US 8,951,215 B2
(45) Date of Patent: Feb. 10, 2015

(54) APPARATUS FOR BODY TREATMENT OF A USER VIA VIBRATIONS IN A LIQUID

(75) Inventor: Alessandro Moretto, Castions di Zoppola (IT)

(73) Assignee: Ideal Standard Intl. BVBA, Brussels (BE)

( * ) Notice: Subject to any disclaimer, the term of this patent is extended or adjusted under 35 U.S.C. 154(b) by 774 days.

(21) Appl. No.: 13/255,068

(22) PCT Filed: Feb. 4, 2010

(86) PCT No.: PCT/IT2010/000038

§ 371 (c)(1),
(2), (4) Date: Oct. 24, 2011

(87) PCT Pub. No.: WO2010/100664

PCT Pub. Date: Sep. 10, 2010

(65) Prior Publication Data

US 2012/0029400 A1 Feb. 2, 2012

(30) Foreign Application Priority Data

Mar. 3, 2009 (IT) ..... MI2009A0306

(51) Int. Cl.
*A61H 1/00* (2006.01)
*A61H 23/02* (2006.01)
*A61H 33/00* (2006.01)

(52) U.S. Cl.
CPC ..... *A61H 23/0263* (2013.01); *A61H 33/6089* (2013.01); *A61H 2201/0169* (2013.01); *A61H 2201/0165* (2013.01)
USPC ..... 601/55; 601/46; 601/158; 4/541.1

(58) Field of Classification Search
CPC ..... A61H 7/00; A61H 23/00; A61H 23/0254; A61H 23/0263; A61H 33/00; A61H 33/6089; A61H 2201/0165; A61H 2201/0169
USPC ..... 601/46, 49, 55, 67, 69, 70, 84, 86, 90, 601/93, 98, 101, 154, 158; 4/538, 541.1, 4/541.3
See application file for complete search history.

(56) References Cited

U.S. PATENT DOCUMENTS

| | | | | |
|---|---|---|---|---|
| 3,020,561 A | | 2/1962 | Cotting | |
| 3,585,991 A | * | 6/1971 | Balamuth | 601/157 |
| 4,109,326 A | | 8/1978 | Holt | |
| 5,896,596 A | * | 4/1999 | Murakami | 4/541.1 |
| 8,226,584 B2 | * | 7/2012 | Knapp et al. | 601/46 |

(Continued)

FOREIGN PATENT DOCUMENTS

| | | |
|---|---|---|
| DE | 27 27 844 A1 | 1/1978 |
| DE | 44 35 879 A1 | 4/1996 |
| DE | 198 24 602 A1 | 12/1998 |

(Continued)

*Primary Examiner* — Quang D Thanh
(74) *Attorney, Agent, or Firm* — Sughrue Mion, PLLC

(57) ABSTRACT

An apparatus is disclosed for treating a user by means of vibrations, comprising: a vessel for accommodating a liquid for immersing the user, provided with a first rim; a motor provided with a cam mechanically coupled to the vessel to cause vibrations of the vessel. The apparatus is characterized in that it further comprises an external casing of the vessel, provided with a second rim covering the first rim, and a fluid-tight seal interposes between the first rim and the second rim and such to reduce the transmission of vibrations from the vessel to the casing.

16 Claims, 10 Drawing Sheets

(56) References Cited

U.S. PATENT DOCUMENTS

| | | | | |
|---|---|---|---|---|
| 8,608,673 | B2 * | 12/2013 | Cao | 4/541.1 |
| 2007/0167882 | A1 * | 7/2007 | Guzzini | 601/3 |

FOREIGN PATENT DOCUMENTS

| | | | |
|---|---|---|---|
| DE | 203 04 886 | U1 | 6/2003 |
| EP | 2 123 949 | A1 | 11/2009 |

* cited by examiner

APPARATUS FOR BODY TREATMENT OF A USER VIA VIBRATIONS IN A LIQUID

CROSS REFERENCE TO RELATED APPLICATIONS

This application is a National Stage of International Application No. PCT/IT2010/000038, filed on Feb. 4, 2010, which claims priority from Italian Patent Application No. MI2009A000306, filed on Mar. 3, 2009, the contents of all of which are incorporated herein by reference in their entirety.

The present invention relates to the field of body treatment apparatuses, such as, for example, bathtubs.

In the field of the beneficial treatments, such as those carried out in spa or sport centres, vibrating boards are used, on which the user stands, holding a handlebar, undergoing, thereby, the vibrations transmitted by the board.

As to the treatments in water, or in any other liquids, bathtubs or swimming-pools are widely used, provided with hydromassage devices, which emit water and/or compressed air jets, which can invest more or less directly a person immersed in bathtub, massaging the concerned part.

The Applicant has recognized the need to provide treatment apparatuses, which may offer a combined action of the benefits arising from transmitting vibration to the body with those arising from immersing in water, or in any other liquids, the body itself or parts thereof.

DE-A-4435879 discloses a bathtub provided, on its exterior of the bottom, with a motor, that transmits vibrations to the bathtub.

DE 27 27 844 A1 discloses an apparatus for treating a user by means of vibrations, according to the preamble of claim 1.

The Applicant has recognized that bathtubs or other items for body treatment by means of vibration in fluids are not commercially available, which are satisfactory as regards to safety and use mode.

It is the object of the present invention to provide an apparatus for body treatment by means of vibration in fluids, which has an improved performance, as compared to the prior art, in terms of user safety, in order to be installed, for example, also in a home environment.

The object of the present invention is achieved by an apparatus for body treatment by means of vibrations comprising:

a vessel defining a hollow region for accommodating a liquid for at least partially immersing a user and provided with a first rim, surrounding at least partially the hollow region;

movement means mechanically coupled to the vessel, for causing vessel vibrations;

an external casing, provided with a second rim covering the first rim;

a fluid-tight seal interposed between the first rim and the second rim and such to reduce the transmission of vibrations from the vessel to the casing, and preferred embodiments thereof, disclosed in claims 2 to 16.

The present invention is disclosed in detail, by way of example, and not as a limit, with reference to the accompanying drawings, wherein.

Figure 8:
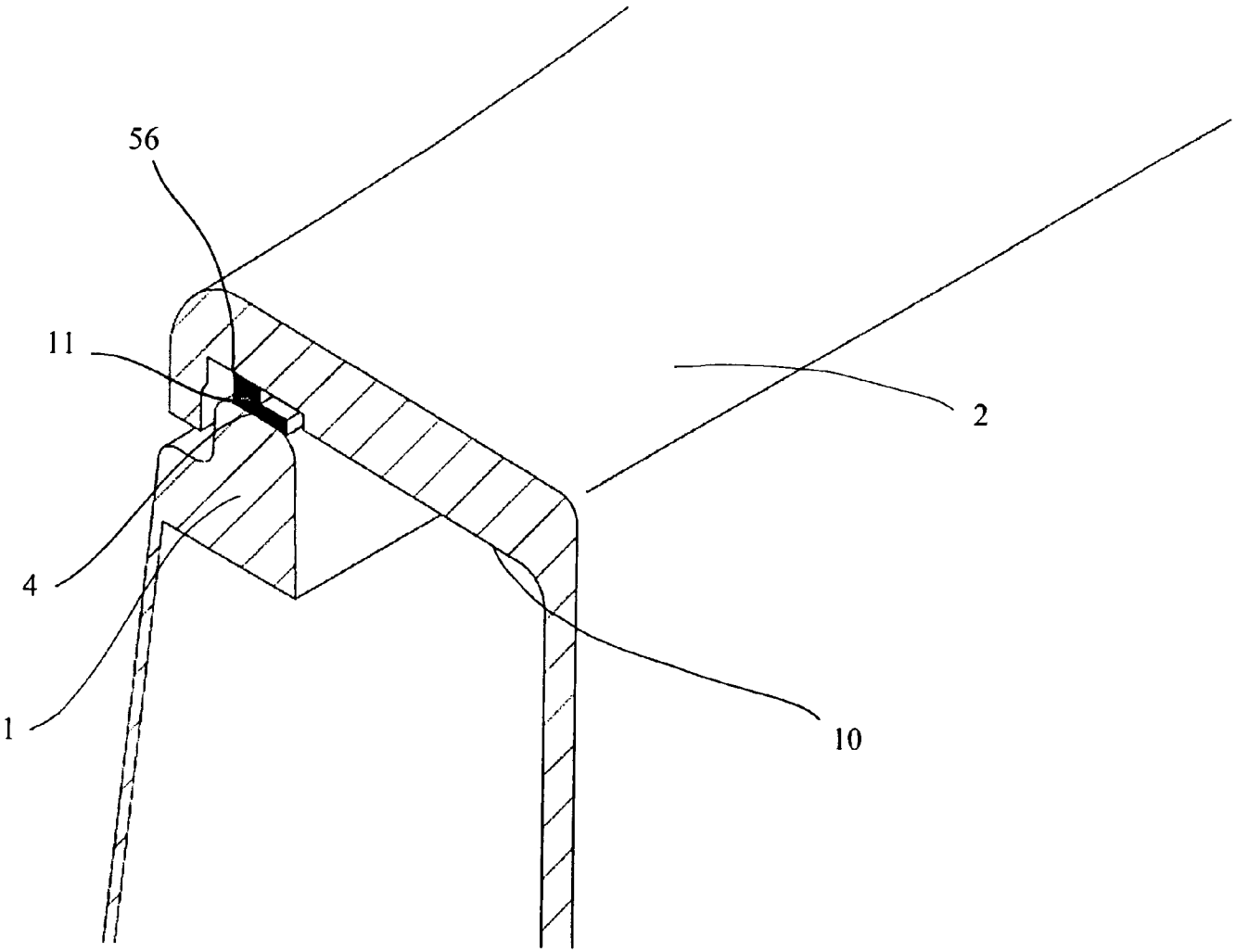
FIG. 8 shows a perspective view of a cross-section portion of the bathtub according to an alternate embodiment of the invention.
Figure 8B:
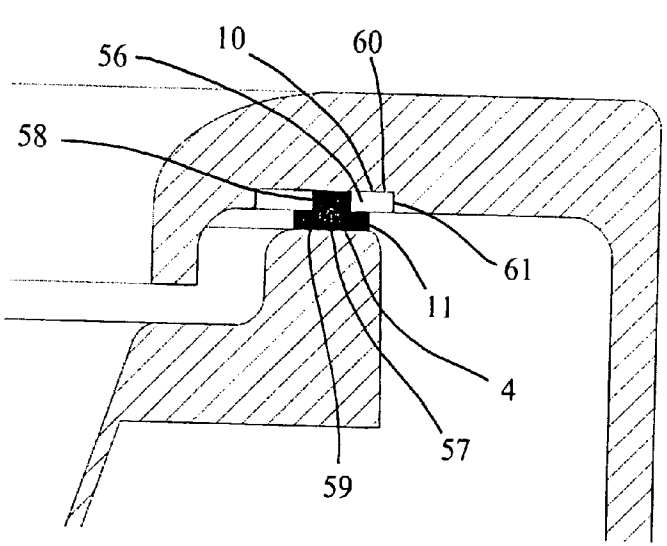
Figure 8A:
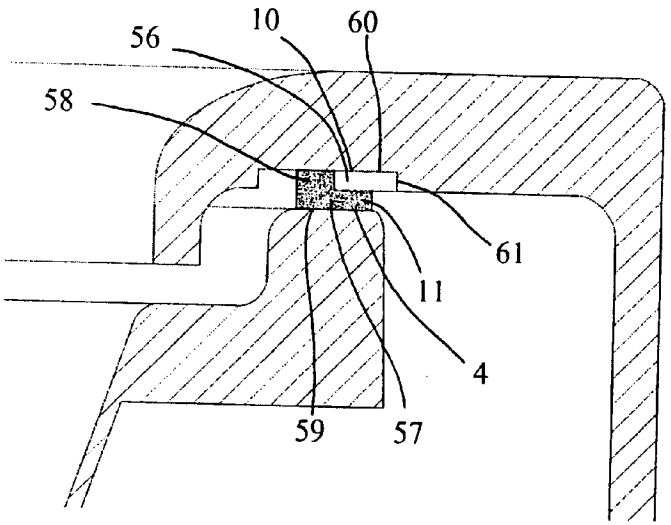
Figure 8C:
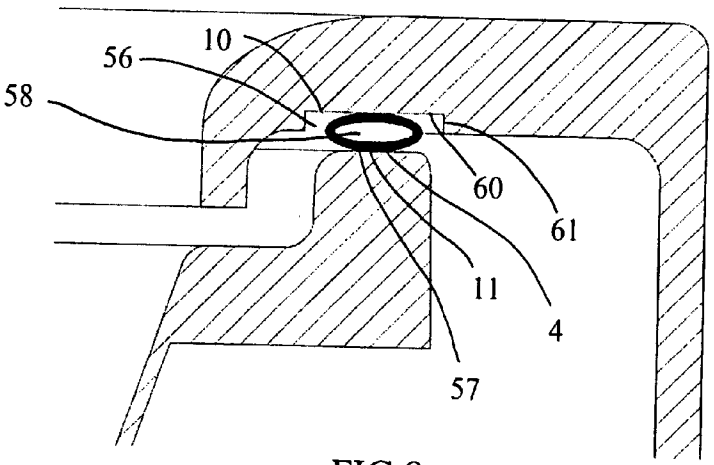
Figure 9:
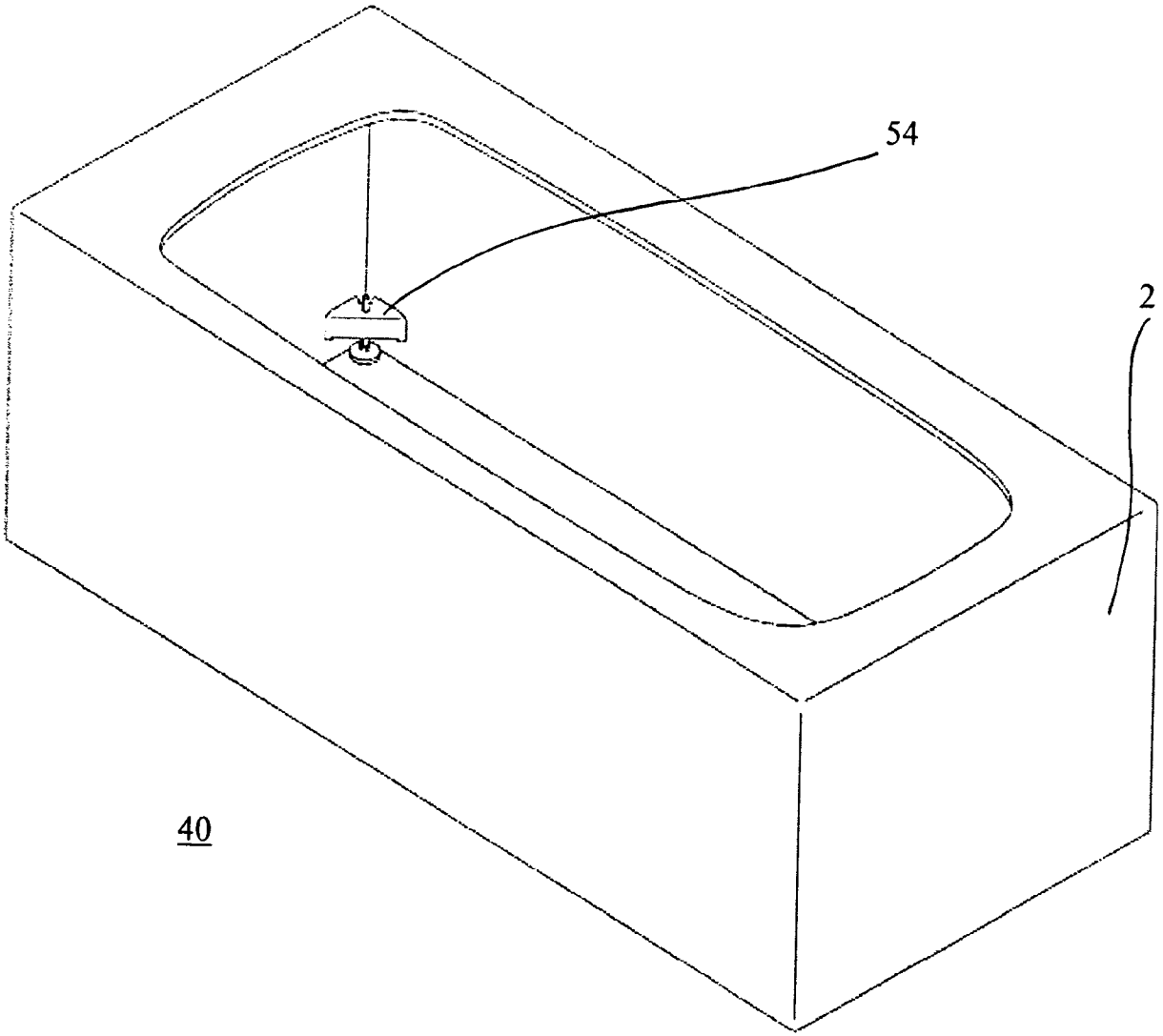
Figure 10B:
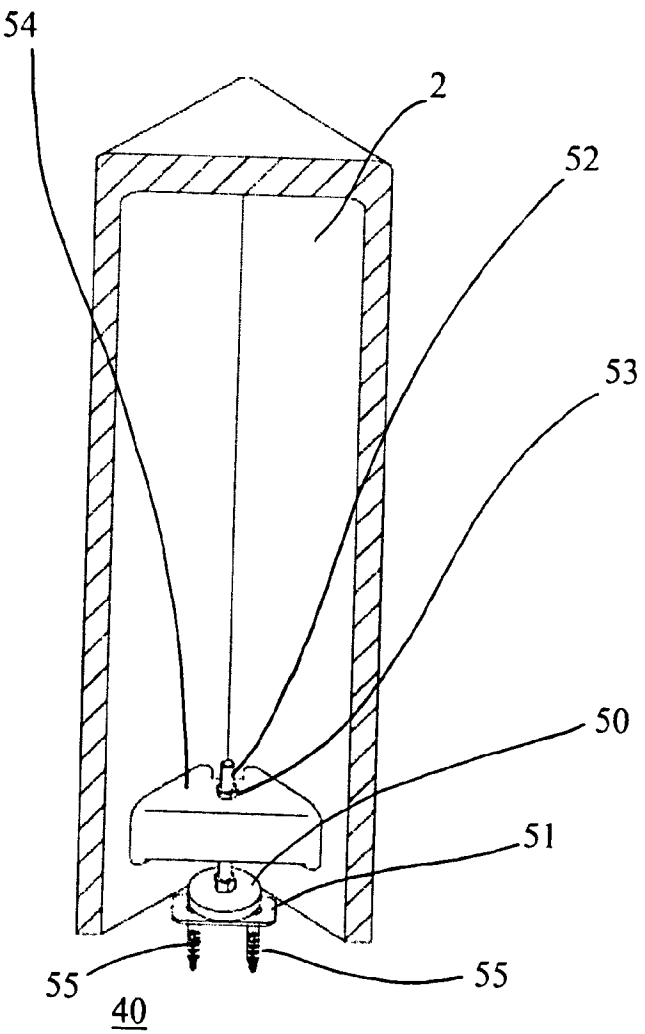
Figure 10A:
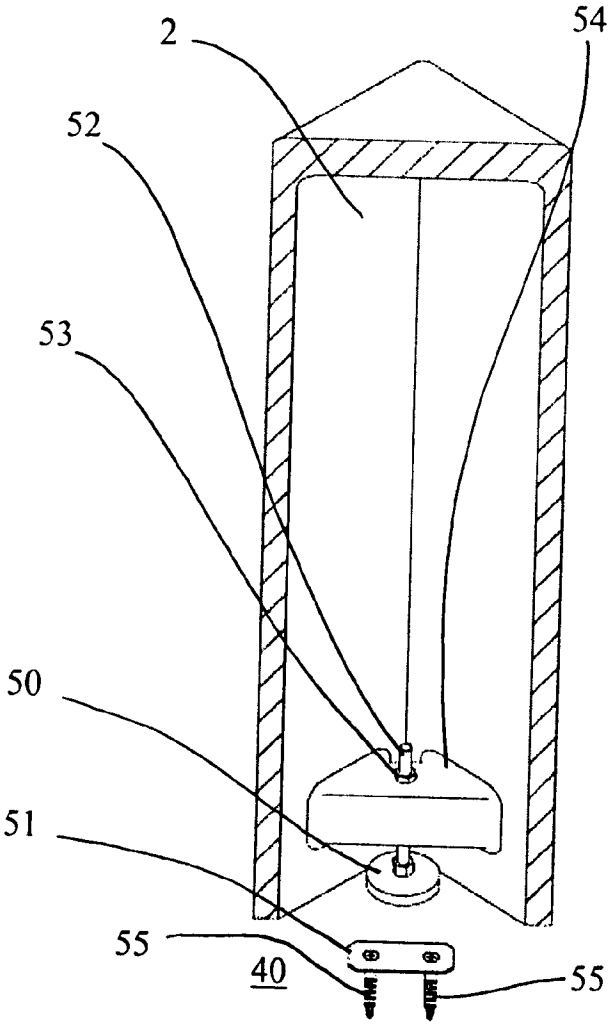

FIGS. 8*a*-8*c* show schematic cross-sectional views of a seal of the apparatus according to three possible alternate embodiments of the invention;

FIG. 9 shows a perspective view of an external casing of the bathtub;

FIGS. 10*a* and 10*b* show perspective views under assembling and exploded conditions, respectively, of a feature of the external casing in FIG. 9.

Figure 1:
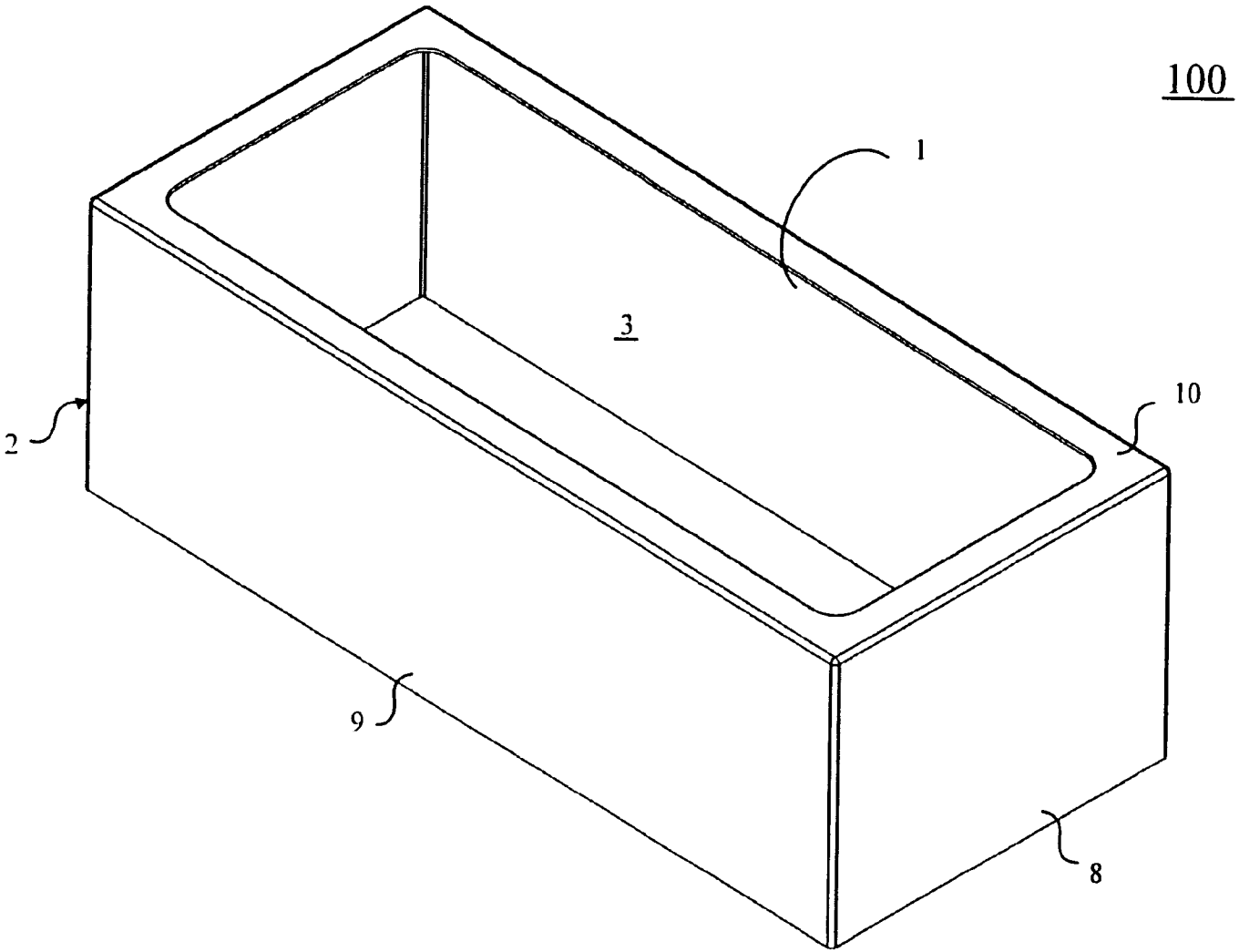
FIG. 1 shows a perspective view of an embodiment of a bathtub.
Figure 2:
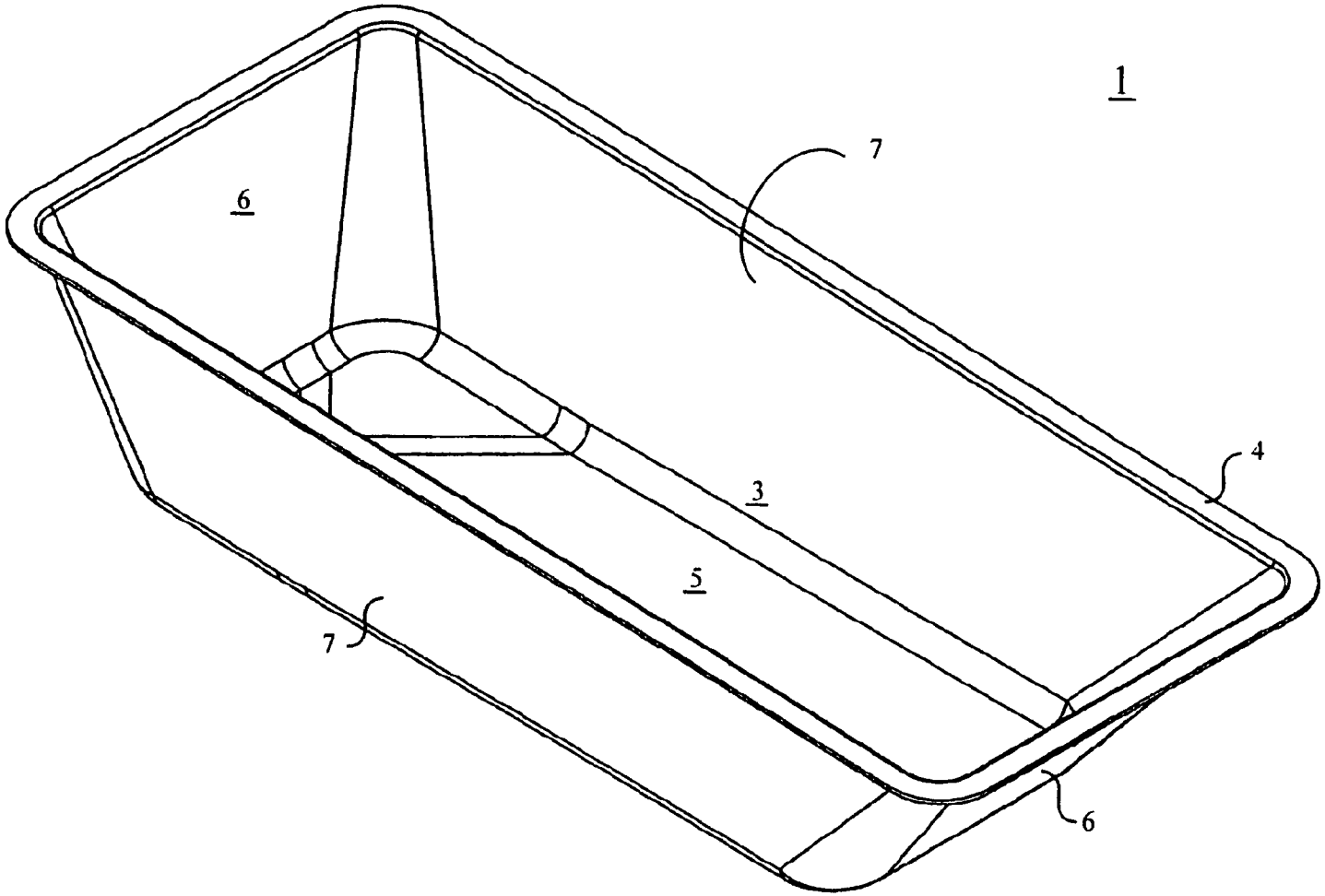
FIG. 2 shows a perspective view of a vessel used in said bathtub.
Figure 3:
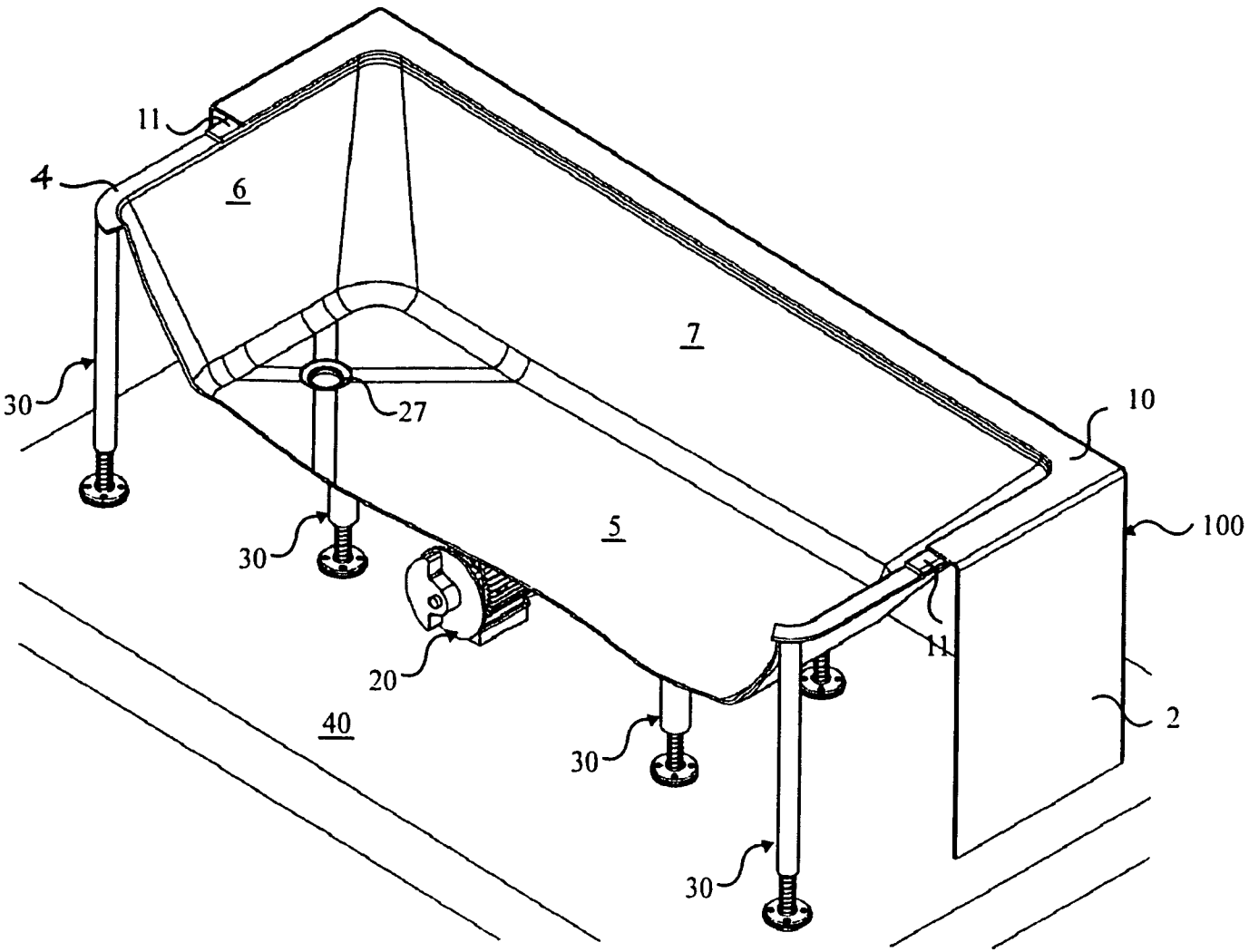
FIG. 3 shows a cross-section perspective view of said bathtub.

FIGS. 1-3 refer to a vibrating-type bathtub 100, comprising a vessel 1 and an external casing 2. Moreover, the bathtub 100 is provided with a movement arrangement 20 (FIG. 3) suitable for causing vibrations of vessel 1. For example, the bathtub 100 is provided with one or more supporting devices 30, mechanically connected to vessel 1 and to a supporting or bearing base 40 of the bathtub itself, such as, in particular, a floor or a stationary board.

Refer now to vessel 1 (FIGS. 1 and 2) which defines an inner hollow region 3 for accommodating a liquid and a user of bathtub 100. As it can be better seen in FIG. 2, the vessel 1 is provided with a first rim 4, which surrounds at least partially the hollow region 3. In particular, the vessel 1 has a substantially rectangular bottom 5, two first minor side walls 6 and two first major side walls 7, facing and connected to the first rim 4, respectively. According to the illustrated example, the first rim 4 extends substantially perpendicularly to the specific side wall of the vessel, it is connected to, developing towards the inside of the vessel 1.

According to the particular embodiment shown in the Figures, the vessel 1 has the characteristic shape of the bathtubs, but the teaching of the invention can be applied also to differently shaped and sized vessels, in respect to those depicted and, for example, suitable to hold a user, who is sitting, kneeling or only suitable for immersing his/her feet. According to the example, the bottom 5 of the vessel is provided with a liquid output hole 27, which, advantageously, can be connected to a proper hydraulic circuit (not shown).

The vessel 1 may be made, for example, of one of the following materials: enamelled steel, plastics with or without reinforcements, stone-resin. Preferably, the vessel 1 is made of thermoformed plastics reinforced with glass-fibres.

The external casing 2 (FIG. 1) at least partially shields and surrounds laterally the vessel 1 and comprises, for example, two second minor side walls 8 and two second major side walls 9, connected to form a box without a bottom and lid. The top portion of the external casing 2 is provided with a second rim 10, which develops from the respective side walls 8-9, to cover the first rim 4 of vessel 1. The casing 2 may have only some of the four walls shown and such walls can be continuous or may be grid-shaped or have the shape of other shielding elements, which restricts the access to the movement arrangement 20. Moreover, the casing 2 may be in one-piece, i.e. a single block, or it may be formed by multiple separate elements to be assembled. According to the example considered, the casing 2 does not carry out supporting functions for the vessel 1, and therefore, it is mechanically decoupled from the supporting devices 30.

In more detail, the casing 2 can be made, for example, of a plastic material with or without reinforcement, in a wood multilayer with or without an aesthetic plating or it may be formed by a sandwich between aluminium sheets, foams with or without external plating, glass plates or purely metal plates. Preferably, the casing 2 is made of a thermoformed plastic material. The casing 2 is fixable to the base 40 by means of brackets and screws, with dowels or magnetic elements or clips of a known type, or it simply rests. According to a possible embodiment (FIGS. 9-10), to the casing 2 a plurality of first plates 50 are associated, capable of being magnetically connected to corresponding second plates 51, secured to the base 40. Preferably, four first plates 50 are provided, arranged at the four corners of the external casing (if the bathtub is rectangular) and as many second plates 52, fixable to the base 40. The first plates 50, preferably circle-shaped, are removably connected to the external casing 2. For example, to each of these a stem 52 may be associated, insertable in a hole 53 provided in an inner flange 54 of the external casing 2. The stem 52 may be for example threaded, so that it can be secured (and possibly adjusted in height) by means of nuts screwed thereon.

The second plates 52, preferably substantially long rectangular-shaped, may be secured to the base 40, for example to a floor, by means of expanding dowels 55 inserted in matching holes (not shown in Figures) previously implemented in the base 40 itself.

Figure 4:
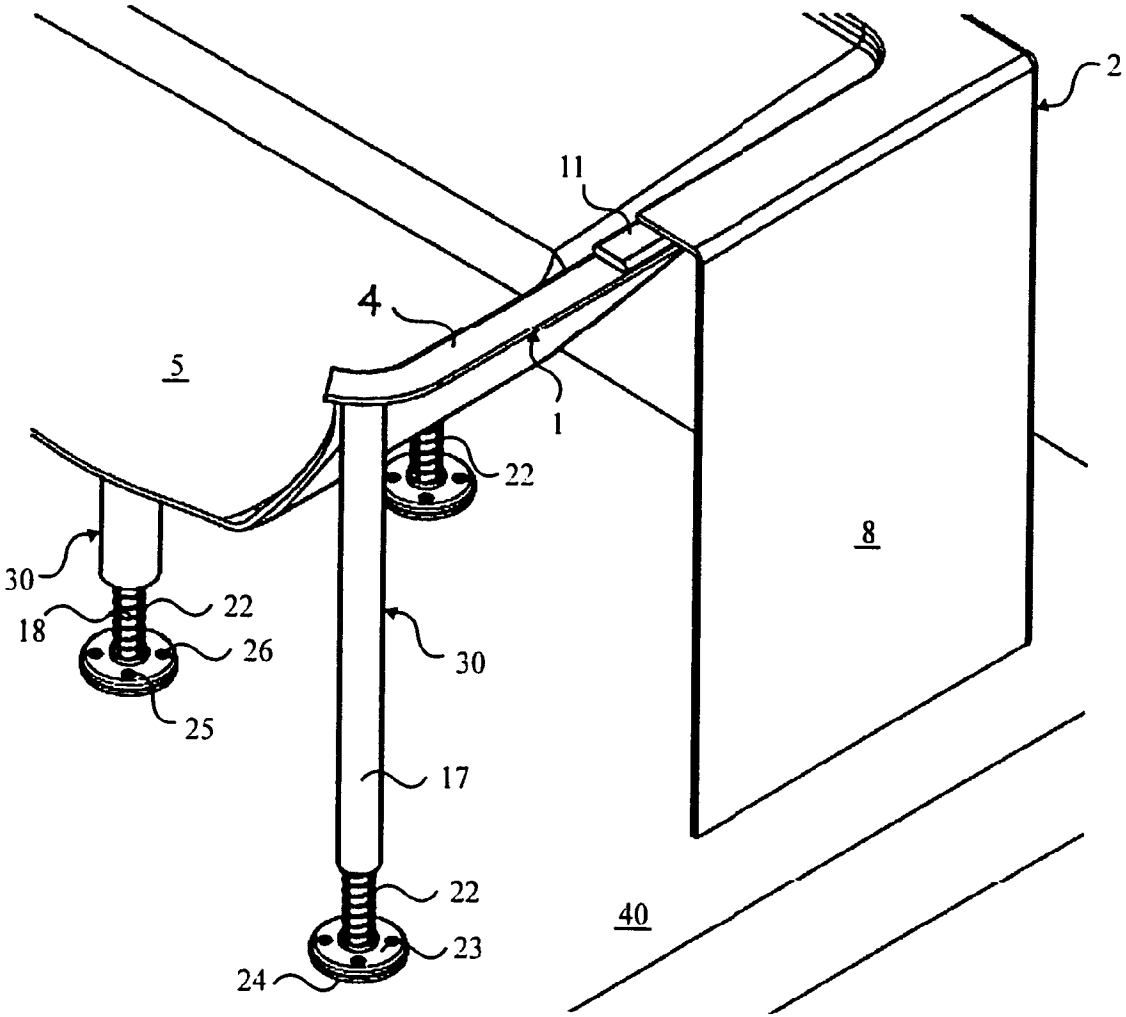
FIG. 4 shows a perspective view of a cross-section portion of said bathtub.

As illustrated in the views in FIG. 3 and FIG. 4, the bathtub 100 is also provided with a fluid-tight seal 11 interposed between the first rim 4 of vessel 1 and the second rim 10 of the casing 2. The seal 11, besides serving a fluid-tight function for the liquid contained in the vessel, also has the function of reducing, by absorption thereof, the transmission of the vibrations implemented by the vessel 1 towards the casing 2.

According to the particular illustrated embodiment, the seal 11 is a strip-shaped element, which covers the first rim 4, but that can also be made by a plurality of side-by-side strip-shaped segments.

Advantageously, the seal 11 may be fixed (preferably bonded) to a top face of the first rim 4 of vessel 1, resulting free to move in respect to the second rim 10, unless a slight friction occurs. Alternatively, the seal 11 can be fixed only to the second rim 10 or to both rims 4 and 10.

Figure 5:
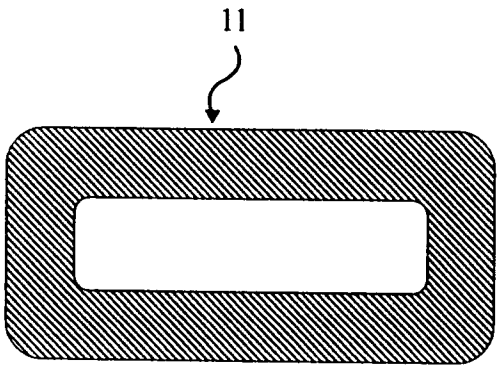
FIG. 5 shows a cross-section of a seal to be used in said bathtub according to a preferred embodiment.

The particular seal 11 shown in FIG. 5 is of a tubular type (hollow inside) and it has a rectangular shape, but it may also be circular or squared or it may have any other shapes which will be illustrated below. Employing a seal 11 of the tubular type results particularly advantageous from the point of view of damping the vibrations and for compensating the varying distance between the two rims 4 and 10. The distance between the two rims may change according to the load exerted on the vessel 1, as an effect of a higher or lower water filling.

According to a first preferred embodiment (FIG. 3), the first rim 4, the second rim 10 and the seal 11 are designed as to hide the seal itself under the second rim 10.

For example, the tubular-type seal 11 has a width ranging within 30 and 40 mm, and a height within 15 and 30 mm, or a diameter ranging between 20 and 30 mm may also have a wall thickness between 5 and 10 mm.

The seal 11 is made of auto-shaping shape-memory material, i.e. a material capable of radically modifying its own shape from a first shape to a second shape, when subjected to proper loads, in particular to higher loads than certain predetermined load values depending on the material itself, and capable of returning to the first shape following the removal of such loads. It is to be noted that the expression "radically modifying its own shape" herein is not to be intended as the normal change of the shape due to, for example, elastic deformations, to which e.g. metals or also rubbers are subject, with which standard seals can be implemented, when they are subjected to even not excessive loads (for example also much lower than breaking loads). Such elastic deformations, actually, can cause minor distortions in the shape, but the latter remains substantially the same. For example, a pressure spread on a rectangular-cross section rubber seal rim will cause a slight distortion in the shape of the cross-section, which, however, will remain substantially rectangular. However, materials exist, that, even when subjected to non-excessive loads, as said above, are capable of undergoing modifications in their relevant forms, and returning to their initial shape once the loads have been removed. Such materials, known per se, can be adopted in the seal 11. Examples of such materials are closed cell foam materials, such as closed cell foams in PVC, which have the above properties of auto-shaping and shape-memory in cold conditions, i.e. at the normal environment temperature of use of an apparatus according to the invention. Preferably, the material to make the seal is chosen with a compressive strength between 1.2 and 2 $N/cm^2$, preferably equal to about 1.6 $N/cm^2$.

The above properties of the material of seal 11 can be usefully exploited for assembling and disassembling the apparatus, in particular the bathtub.

In fact, the external casing 2 comprises at the second rim 10 a shaped seat 56 (not shown in FIGS. 3-4), suitable for accommodating, therein, the seal 11 (FIGS. 8-8*c*). The shaped seat 56 is located and develops in the second rim 10 of the external rim 2, such that the seal 11, previously located on the first rim 4 of vessel 1, locates within the shaped seat 56 when the apparatus 100 is assembled.

With further advantage, the external casing 2, which, when under assembling conditions, loads on the seal 11 discharging its weight thereon, has a weight capable of urging the seal 11, in order to cause the radical deformation thereof (as previously defined). In other words, the weight of the external casing 2 exerts on the seal 11 higher stresses than the predetermined stress values, such to make it change from the initial shape (non-deformed) to the final shape (radically deformed). When the seal 11 is urged by the weight of the external casing 2, it expands inside the shaped seat 56 and fits, at least partially, its shape. This adjustment of the seal 11 guarantees the correct maintenance of the relative positioning between the external casing and the vessel 1, besides, of course, an effective seal.

If, for example, for the apparatus maintenance needs, the external casing is removed, its weight stops discharging on the seal 11. This, as a result of the shape-memory of the material it is made of, returns to its initial shape. The assembling operation can therefore be repeated without requiring the seal to be replaced.

Preferably, the shaped seat 56 has a substantially rectangular shape (or square or any similar shape). In this manner, the seal 11, when expanding as a result of the external casing weight, adheres to at least one top wall 60 thereof and, preferably, also to a side wall 61 thereof, for example arranged on the inner side of the apparatus. Such an adherence along the side wall 61 for the entire extension of the seal 11 (and the shaped seat 56), or at least part thereof, implements a restriction which opposes the relative lateral movements of vessel 1 in respect to the external casing 2 as an effect of the vibrations of vessel 1.

Besides the previously described shapes, in order to optimize the above mentioned behaviour, the seal 11 can have further shapes in cross-section. With reference to the seal 11 in its non-deformed shape, it has, advantageously, a cross section comprising a main portion 57 and an auxiliary portion 58. It is to be noted that, "resistant section" means the cross section of the seal in its axial development direction. The main portion 57 has a resistant section with a larger extension than that of the auxiliary section 58, which can be, possibly, null.

For example, the seal 11 can have an L-section (FIG. 8*a*). In such a seal, the main portion 57 has a rectangular or square form, and the auxiliary portion 58 has a square or rectangular shape, with a lower surface. The main portion 57 is preferably secured to the first rim 4 of vessel 1, for example by arranging an adhesive on the lower face 59 of the main portion 57. Providing the auxiliary portion 58 with a smaller resistant section facilitates the deformation of the seal 11 within the shaped seat 56 according to the said modes. The auxiliary portion 58 may be alternatively on either the inner side or the external side of the main portion, i.e. facing the vessel or the exterior of the apparatus. The so shaped seal, if the shaped seat 56 is rectangular in shape, when it is subjected to the weight of the external casing, radically modifies its own shape, becoming substantially rectangular. In particular, the auxiliary portion 58, substantially, disappears, whereas, the main portion 57 remains substantially rectangular, but it is reduced in height (distance between the top rim and the bottom rim), increasing its width. Possibly, bulging can occur on the main portion sides.

The seal 11 may, alternatively, have a T-section (FIG. 8*b*), which differs from the previously described L-section, because the auxiliary portion 58 is in a centred position, rather than lateral, in respect to the main portion 57. Also in this case, the main portion 57 is preferably secured to the first rim 4 of vessel 1, for example, by arranging an adhesive on a lower face 59 of the main portion. Also such a seal modifies its own shape analogously in respect to the L-seal.

According to a further embodiment (FIG. 8*c*), the seal 11 has a tubular section, wherein the main portion 57 of the section has an annular conformation, and the auxiliary portion 58 is empty (null resistant section).

Figure 7:
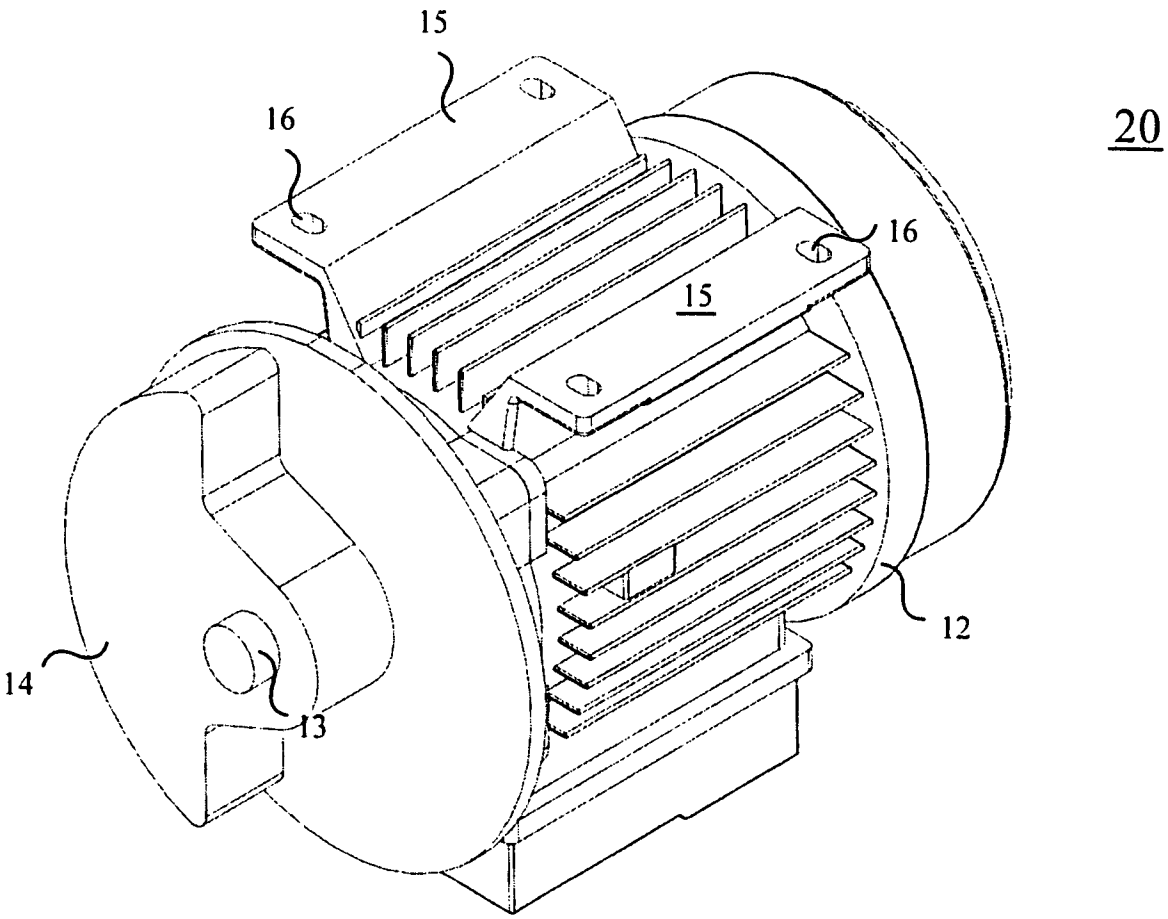
FIG. 7 shows an example of a movement arrangement, suitable for causing vibrations to said vessel.

Refer now to the movement arrangement 20 (FIG. 3 and FIG. 7), which comprises an electric engine 12, conventional per se, provided with a rotating shaft 13 on which one or more cam elements 14 are mounted.

The electric motor 12 is, for example, a brushless motor (such as a mono- or tri-phase asynchronous motor), suitable for reaching, in particular, a rotational speed between 800 rounds/s and 3600 rounds/s and it can be driven by an electronic device connected thereto or integrated (for example an inverter).

The motor 12 can operate in a fixed or intermittent fashion. The presence of one or more cam elements 14 introduces an offset, which causes a vibrational movement, for example, longitudinally along the vessel 1, with a frequency between 10 and 50 Hz.

In particular, the motor 12 is an electric motovibrator with pre-lubricated bearings and with mechanical and electrical arrangements suitably protected according to the international regulation in force for the bath areas or the like.

As an alternative in respect to the illustrated brushless motor 12, other movement arrangements may be used, such as a brushed motor or other electrical arrangements, which act on the eccentric mass rotation by means of an indirect transmission of movement, with the help of pulleys and belts, intermediate gears or chains. The same rotation may be generated by non-electric devices, but hydraulic, where by the help of turbines, the movement of an incoming liquid from an off-board construction will be used, to provide the movement to a shaft, which, in turn, will be connected to the above described masses.

The motor 12 is advantageously provided with one or more flanges 15, integral with a motor case 12 and provided with through-holes 16 for accommodating fastening screw to an external face of bottom 3 of the vessel 1. Alternatively, motor 12 may be fixed to vessel 1 by bonding or clamping or any other suitable fashion. Moreover in the region underlying the vessel 2, supplying and/or driving electric wires of the movement arrangement 20 may be provided.

Figure 6:
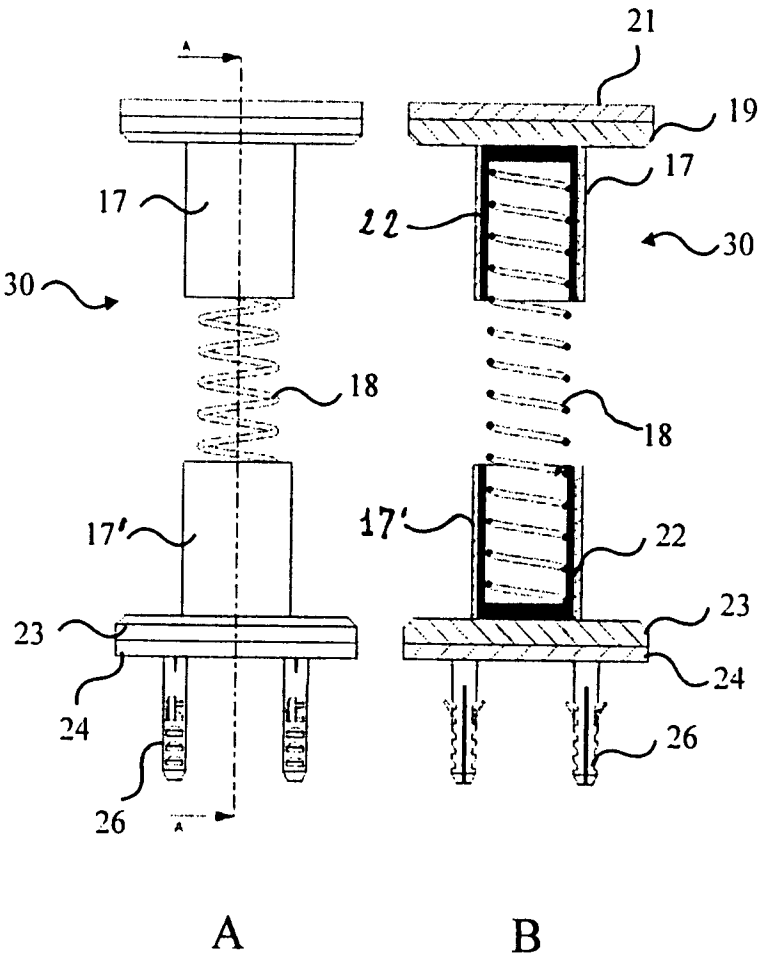
FIGS. 6A and 6B show a side view and cross-sectional view of a supporting device of said vessel according to a particular embodiment.

FIG. 6 (A and B views) refers to a particular embodiment of supporting device 30, of telescopic type. The supporting device 30 comprises an upper tubular structure 17 and a lower tubular structure 17', which define respective housings and a coil spring 18, slidingly housed in the tubular structures 17 and 17'. Proximally to one or both ends of the coil spring 18, a shock damper element 21 such as, for example, a rubber disk, is arranged.

In more detail, the upper tubular structure 17 is provided with an upper flange 19 fixable to vessel 1 with the interposition of a first rubber disk 21 suitable to damper (i.e. to mitigate) the shocks vertically caused by the vibrations caused by the movement arrangement 20.

Further, according to the disclosed example, the upper 17 and lower 17' tubular structures accommodate a respective optional rubber tubular element 22 (or made of any other elastic material), in which a spring 18 develops, in order to exert an opposing force on an inner wall of the upper flange 19. The coil spring 18 and the tubular element 22, when provided, have such dimensions to enable the extension and the compression of the spring inside the relative tubular structure 17 and 17'.

The rubber tubular element 22 included in the lower tubular structure 17' rests, and in particular is fixed on a foot 23 having a lower surface in contact, for example, with a second rubber disk 24, analogue to the first disk 21.

The foot 23 and the second rubber disk 24 are provided with respective through-holes 25 for inserting screws 26, preferably provided with expanding dowels, to be inserted in the base 40 for fixing the supporting device 30 thereto.

According to an exemplary embodiment, eight supporting devices 30 are used, four of which are arranged at the four corners of vessel 1 and the other four are applied to the bottom 3 of vessel 1. FIGS. 3 and 4 show another typology of such a supporting device 30 according to which, only one upper tubular structure 17 is provided, and no lower tubular structure is provided, which accommodates the rubber tubular element 22 and the spring 18.

As an alternative to the illustrated and described supporting devices 30, other telescopic or non telescopic supporting elements may be used provided with shock damper elements, which follow the vibrations imposed to the vessel 1, such as, for example, hydraulic damper devices.

In operation, the user immerses in the bathtub 100 actuating the motor 12. The motor 12 causes the shaft 13 and the cam element 14 to rotate, which, when rotating, causes vibrations to motor 12, which transmit to the bathtub 100. These vibrations of the bathtub 100 and the liquid contained therein are pleasant and beneficial to the user. During the vibrations, the casing 2 is substantially stationary or it is subject to extremely reduced vibrations in respect to those of vessel 1. Moreover, the region interposed between the vessel 1 and the casing 2, wherein the motor 12 and the supporting devices 30 are arranged, is not concerned with splash of liquid, which is in the vibrating vessel 1.

The presence of the seal 11 is particularly advantageous, since it allows the use of a casing shielding the vessel 1 and allows obtaining a substantially fluid-tight seal of the contact region between the vessel and the casing and, at the same time, reduces the transmission of the vibrations from the vessel to the casing. It is to be observed that the water insulation in the area where the movement arrangement 20 is secured, also concerned with electric wiring, seems extremely advantageous. The described bathtub, therefore, is extremely safe and efficient.

From the previous description it is clear that the teaching of the invention can be applied not only to the bathtubs, but also to any other kind of apparatus for the user treatment, to be used in his/her own house, such as, for example, shower cubicles, partial immersion bathtubs or other sanitary items. Moreover, such a treatment apparatus may be used in a house or in specialized structures, which offer beneficial treatments, such as gyms, swimming-pools, spa or hospitals.

Finally, the present invention is susceptible of a number of modifications and variants, all of which fall within the appended claims, whereas the technical details may vary as needed.

The invention claimed is:

1. Apparatus for a user treating by means of vibrations, comprising:

a vessel defining a hollow region for accommodating a liquid for at least partially immersing the user and provided with a first rim surrounding at least partially the hollow region;

movement means mechanically coupled to the vessel to cause vibrations of the vessel;

an external casing of the vessel provided with a second rim covering the first rim;

a liquid-tight seal interposed between the first rim and the second rim and such to reduce transmission of vibrations from the vessel to the casing, characterized in that said seal is made of an auto-shaping shape-memory material capable of radically modifying its shape from a first shape to a second shape, when subjected to loads higher than predetermined load values, and of returning to the first shape following the removal of said loads higher than the predetermined load values, wherein said auto-shaping shape-memory material is a closed-cell foam material, wherein said seal, in its initial form, has a transversal cross-section having an L-, or T-, or tubular shape, and in that said external casing comprises at the second rim a shaped seat having a substantially rectangular or square shape, having a top wall and a side wall suitable to accommodate said seal, wherein said external casing has a weight suitable for urging the seal with loads higher than said predetermined load values in assembled conditions of the apparatus, such that, when urged by the weight of the external casing, the seal passes from an initial form to a final form, deforming in the shaped seat of the second rim and adapting at least partially to its shape adhering at least to said top wall and said side wall, and, following removal of the external casing, the seal returns to its initial shape.

2. The apparatus according to claim 1, wherein said seal is a strip-shaped element, which covers the first rim.

3. The apparatus according to claim 1, wherein said seal is glued to an upper face of the first rim and it is substantially free to move in respect to the second rim.

4. The apparatus according to claim 1, wherein said casing is made of a thermoformed plastic material, and it is one of the structures included in the group formed by: single-block structure, assembled-wall structures, continuous wall-structure, grid-structure.

5. The apparatus according to claim 1, wherein said casing surrounds at least partially the vessel and has at least a side wall, connected to the second rim.

6. The apparatus according to claim 1, wherein said movement means comprises at least a device for securing to bottom of said vessel external to recess.

7. The apparatus according to claim 1, wherein said movement means comprises an electric motor provided with a rotating shaft on which at least a cam element is mounted.

8. The apparatus according to claim 1, further comprising supporting means of vessel mechanically coupled to vessel and to a bearing base of the apparatus.

9. The apparatus according to claim 8, wherein the supporting means is mechanically uncoupled from said casing, which does not serve the function of supporting the vessel.

10. The apparatus according to claim 8, wherein the supporting means comprises at least a telescopic supporting device including:

a tubular structure defining a seat and which is connected to said vessel;

a coil spring, that can be slidingly housed in said tubular structure and can be connected to a rest foot;

at least a shock damper element arranged in proximity of a least one end of said coil spring.

11. The apparatus according to claim 10, wherein the coil spring is at least partially housed in an elastic tubular element suitable for sliding in said tubular structure.

12. The apparatus according to claim 1, wherein said apparatus is included in the group consisting of: a bathtub, a shower cubicle, a partially user-accommodating bathtub.

13. The apparatus according to claim 1, wherein said auto-shaping shape-memory material has a compressive strength comprised between 1.2 and 2 $N/cm^2$.

14. The apparatus according to claim 1, wherein said auto-shaping shape-memory material is a closed cell PVC foam.

15. The apparatus according to claim 1, comprising magnetic means for fixing said external casing to a supporting base for the apparatus.

16. The apparatus according to claim 15, wherein said magnetic means comprises a plurality of first plates removably connectable to the external case suitable to be magnetically connected to corresponding second plates fixable to the base.

* * * * *